US006553718B2

(12) United States Patent
Arquevaux et al.

(10) Patent No.: US 6,553,718 B2
(45) Date of Patent: Apr. 29, 2003

(54) CABLE TENSIONING DEVICE

(75) Inventors: Laurent Arquevaux, Sully-sur-Loire (FR); Yaun Le Gallo, Orleans (FR); Herve Doreau, Orleans (FR); Richard Dubas, Orleans (FR)

(73) Assignee: Meritor Light Vehicle Systems-France, Sully-sur-Loire (FR)

( * ) Notice: Subject to any disclaimer, the term of this patent is extended or adjusted under 35 U.S.C. 154(b) by 0 days.

(21) Appl. No.: 09/886,955

(22) Filed: Jun. 21, 2001

(65) Prior Publication Data

US 2002/0020116 A1 Feb. 21, 2002

(30) Foreign Application Priority Data

Jun. 22, 2000 (FR) ..... 00 07994
Jan. 23, 2001 (FR) ..... 01 00855

(51) Int. Cl.[7] ..... E05F 11/48
(52) U.S. Cl. ..... 49/352
(58) Field of Search ..... 49/352, 348, 349, 49/502

(56) References Cited

U.S. PATENT DOCUMENTS

| | | | | | |
|---|---|---|---|---|---|
| 1,535,989 | A | * | 4/1925 | Clas | 49/352 |
| 4,235,046 | A | | 11/1980 | Hess et al. | |
| 4,823,512 | A | * | 4/1989 | Maekawa et al. | 49/352 |
| 4,970,827 | A | * | 11/1990 | Djordjevic | 49/352 |
| 5,074,077 | A | * | 12/1991 | Toyoshima et al. | 49/352 |
| 5,309,678 | A | * | 5/1994 | Adachi | 49/352 |
| 5,505,022 | A | * | 4/1996 | Shibata et al. | 49/352 |
| 5,623,785 | A | * | 4/1997 | Mariel | 49/352 |
| 5,657,580 | A | * | 8/1997 | Kobrehel | 49/352 |
| 6,161,337 | A | * | 12/2000 | Morando | 49/352 |

FOREIGN PATENT DOCUMENTS

| | | | | |
|---|---|---|---|---|
| DE | 32 01 098 | | 7/1983 | |
| DE | 3144497 | * | 9/1983 | 49/352 |
| EP | 982165 | * | 8/1999 | 49/352 |
| FR | 588041 | * | 4/1925 | 49/352 |
| FR | 2 733 292 | | 10/1996 | |
| GB | 265888 | * | 2/1927 | 49/352 |
| RU | 563471 | * | 6/1977 | 49/352 |

* cited by examiner

*Primary Examiner*—Jerry Redman
(74) *Attorney, Agent, or Firm*—Carlson, Gaskey & Olds, P.C.

(57) ABSTRACT

The window lifter comprises a window slider, a cable driving said window slider, a spring having a mobile cable tensioning portion and having a fixed cable return portion, both portions engaging the cable. This window lifter provides a simplified fabrication and a reduced number of parts.

20 Claims, 5 Drawing Sheets

CABLE TENSIONING DEVICE

BACKGROUND OF THE INVENTION

The invention relates to a window lifter for a vehicle door comprising a guide rail, a slider slidingly mounted on said rail and supporting a window glass, at least one branch of the cable passing over cable guiding or returning means provided at the ends of said rail and connecting said slider to a drive drum mounted on a side plate integral with said rail and means for tensioning at least one branch of said cable.

Correct operation of this so-called "cable-operated" window lifter is ensured only if the cable is kept taught over its whole length.

If this is not the case, the absence of tension in the cable affects angular play in the window lifter crank. Insufficient tension in the cable can also lead to the cable escaping from the guides or channels provided in the cable guiding or returning means and incorrect winding in the channels provided on the drive drum.

The cable guiding or returning means generally consist of channels or grooves formed at the ends of the rail, the cable sliding therein, or peripheral grooves on direction-changing pulleys pivotally mounted on axes perpendicular to the plane formed by the cable branches.

Cable length is calculated to allow a slight operating slack, and to ensure the cable can be mounted when assembling the window lifter.

FR-A-2 733 292 provided a cable tensioning device comprising a cam rotatively mounted at one end of a rail and including an arm having a channel in which the cable slides, said cam being biased by a spring coaxial with said cam whereby the channel provided at the end of said arm exercises an outwardly-directed force on the said cable.

DE-A-3201098 provides a window lifter cable tensioning device comprising a cable return means mounted on a cam. The cam is biased by a curved helical spring.

These tensioning devices require the manufacturing and the assembly of at least two parts: the cam and the coaxial spring.

U.S. Pat. No. 4,235,046 provides a window lifter cable tensioning device comprising a deflecting element which engages and guides a cable in a loop-shaped path. A spring in a permanently stressed condition biases the deflecting element in a direction to lengthen the path of the cable.

This tensioning device requires a complicated spring and deflecting element assembly.

There is also a need for a window lifter providing a reduced assembly time and a reduced number of parts.

SUMMARY OF THE INVENTION

The window lifter according to the invention comprises a window slider, a cable driving said window slider, a spring having a mobile cable tensioning portion and having a fixed cable return portion, both portions engaging the cable.

In another embodiment, the window lifter further comprises a support plate having a cable return means, and wherein the fixed portion of the spring is engaged between the cable and the cable return means.

In a further embodiment, the window lifter the fixed spring cable return portion is attached to the cable return means.

In still another embodiment, the window lifter further comprises a tab fixed to the support plate and said return means comprises two flanges on both sides of the spring, said flanges having respective aligned slots through which the tab extends.

The spring mobile portion has preferably a cable guiding channel portion.

The fixed portion has preferably a cable guiding channel.

In a particular embodiment, the spring is a plate spring.

In an alternative embodiment the window lifter comprises a window slider, a cable driving said window slider and a wire spring having a fixed portion and a mobile cable tensioning portion having a loop through which the cable passes.

In another embodiment, the wire spring is located at the side of a cable return means and the spring fixed portion has a curved end that engages resiliently with the slider.

The loop can have an aperture adapted for inserting the cable in the loop.

The window lifter can also comprise a supporting plate having cable sheath stops, a drum mounted rotatably on the supporting plate, driving the cable, a slider guiding rail having two cable return means, separated from the supporting plate, and having cable sheath stops and cable sheaths surrounding the cable between respective rail cable sheath stops and supporting plate cable sheath stops.

The window lifter can also comprise a slider guiding rail having two cable return means at its ends and having a protruding plate, a drum mounted rotatably on the protruding plate and driving the cable.

The window lifter can also comprise a supporting plate having two cable sheath stops, two sliding guiding rails separated from the supporting plate, having respectively two cable return means and two cable sheath stops, and three cable sheaths surrounding the cable respectively between a first rail cable sheath stop and a first supporting plate cable sheath stop, between a second rail cable sheath stop and a second supporting plate cable sheath stop and between remaining cable sheath stops of the first and second rail.

BRIEF DESCRIPTION OF THE DRAWINGS

A non-limiting embodiment of the invention will now be described with reference to the attached drawings, in which.

DETAILED DESCRIPTION OF THE PREFERRED EMBODIMENT

Figure 1:
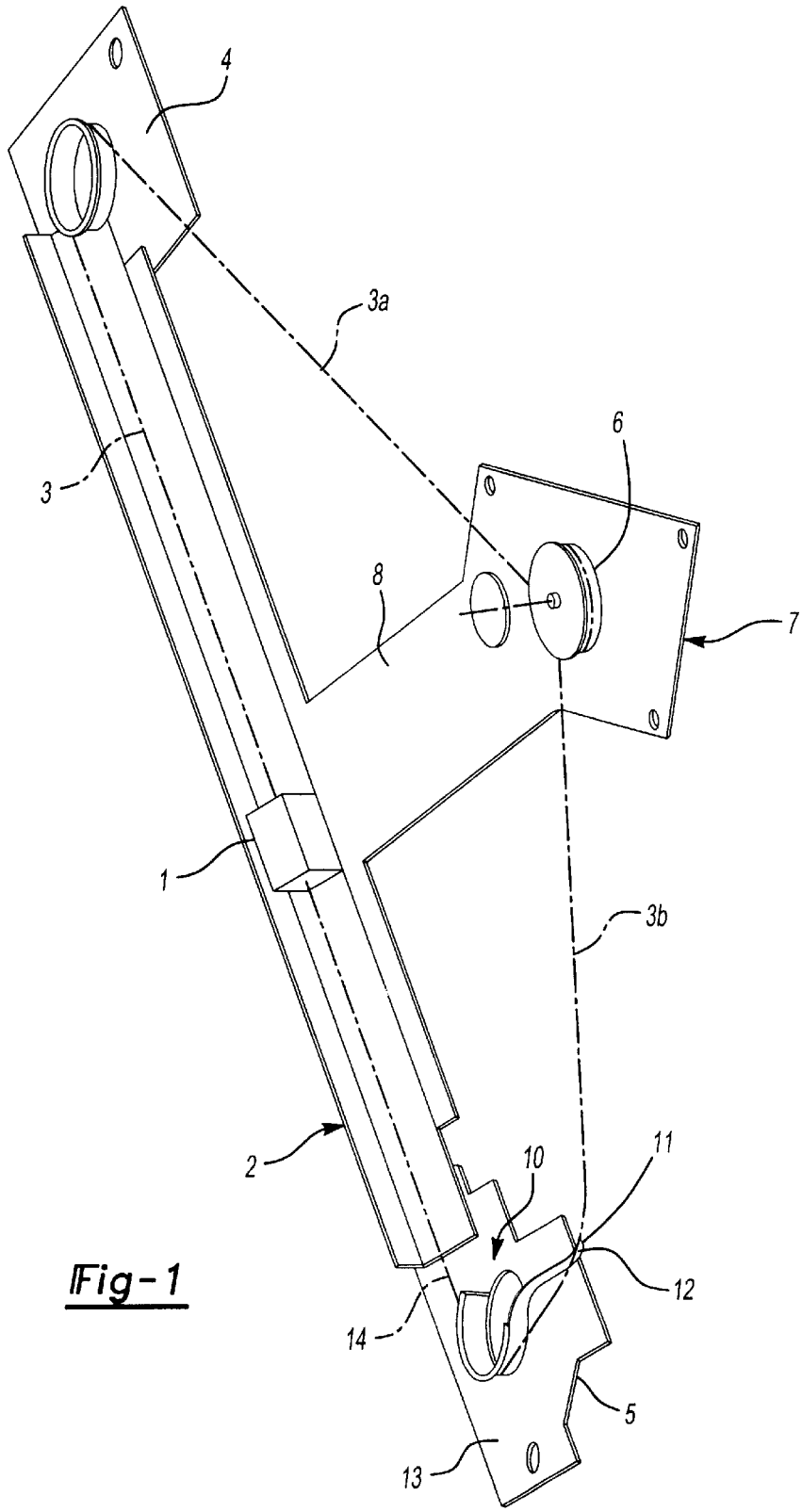
FIG. 1 is a simplified perspective view of a window lifter of the cable type fitted with a cable-tensioning spring according to a first embodiment of the invention.

The drawings show a slider 1 slidingly mounted on a rail 2 designed to be fixed vertically inside an automobile vehicle door. Slider 1 carries a window glass not shown on the drawings. Slider 1 is raised or lowered by a cable 3 the upper branch 3*a* of which passes over cable guiding or returning means 4 provided at the upper end of the rail 2. The lower branch of the cable 3*b* passes under cable guiding or returning means 5 provided at the lower end of rail 2. The ends of cable branches 3*a*, 3*b* are fixed to a drive drum 6 driven by a handle or speed-reduction gear, not shown on the drawings. When slider 1 is raised along the rail 2, branch 3*b* unwinds from drum 6 and the upper branch 3*a* is wound onto the same drum 6. Conversely, when slider 1 is lowered, the lower branch 3*b* is wound around drum 6 and the upper branch 3*a* is unwound from drum 6.

The upper cable guide 4 and lower cable guide 5 comprise at least one circular portion. The portion is formed, for example, by stamping and rolling, in the ends of rail 2.

Drive drum 6 is mounted rotatively on an axis perpendicular to the general plane containing cable 3, on a small plate 7 provided at the end of a side arm 8 integral with rail 2.

Reference numeral 10 indicates means carried by rail 2 or side arm 8, allowing it to keep at least one of branches 3*a* or 3*b* permanently under tension. These means comprise a spring shaped such that at least one of its ends 11 has a guiding channel 12 that slidingly bears against cable 3.

Figure 2:
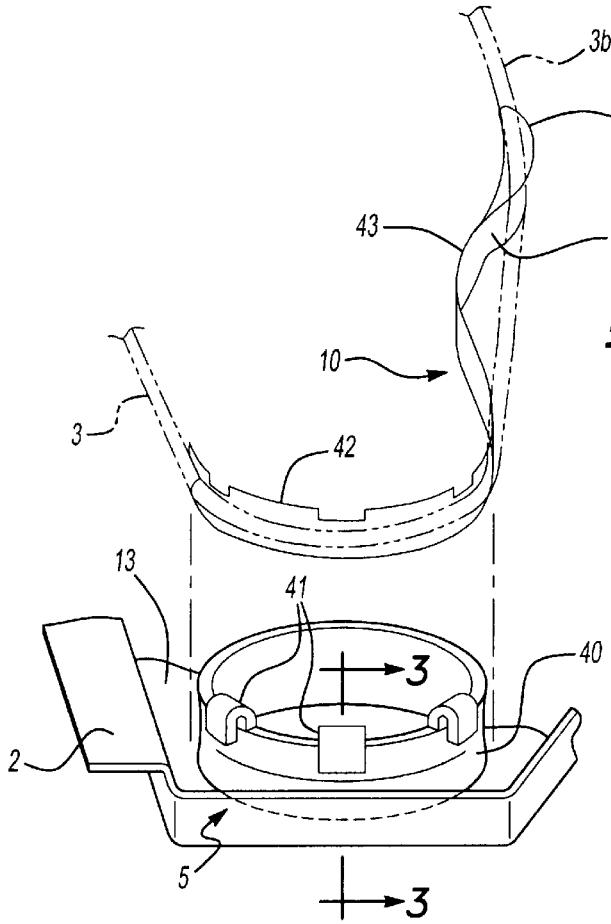
FIG. 2 shows, in a perspective and exploded view, the arrangement of a plate spring according to an alternative of the first embodiment of the invention.
Figure 3:
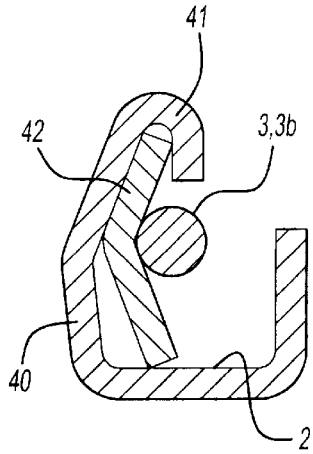
FIG. 3 shows in cross section the spring of FIG. 2.

In the first embodiment shown in FIGS. 1 to 3, the lower end 13 of rail 2 carries a fixed circular channel 40, formed for example by stamping or rolling. This channel 40 is provided with a single hook 41 extending along the channel periphery in the example of FIG. 1. The channel is provided with three hooks 41 in the example of FIGS. 1 and 2. These hooks can be formed by stamping.

Plate spring 10 has a cylindrical fixed cable between portion 42 which matches the outer peripheral surface of fixed channel 40, and is secured in place there by folding over hooks 41.

Advantageously, cylindrical fixed cable between portion 42 has a shallow V-shape so as to form a channel in which lower branch 3*b* slides. The cylindrical fixed cable between portion 42 is extended at drive drum 6 side by a flexible arm 43 terminated by guiding channel 12. Guiding channel 12 bears against lower branch 3*b* exercising an outwardly-directed force on the latter. In this embodiment, plate spring 10 simultaneously performs the role of lower cable guiding or returning means 5 and that of tensioning the cable 3. The same device can be mounted at the upper end of rail 2. The other end of rail 2 can obviously be fitted with the same type of fixed circular channel for supporting a spring.

It should be noted that branch 3 when mounted and tensioned has a polygonal shape. When it is said in this specification that guiding channel 12 exercises an outwardly-directed force, it is understood that this force is located in the plane of the polygon and is directed outwardly of the polygon. Conversely, when the force is exercised inwardly, it is to be understood that the force is directed towards the inside of the polygon. Though the invention has been described above with a plate spring exerting an outwardly-directed force on the cable, it is also possible to use a similar spring exerting an inwardly-directed force.

Figure 4:
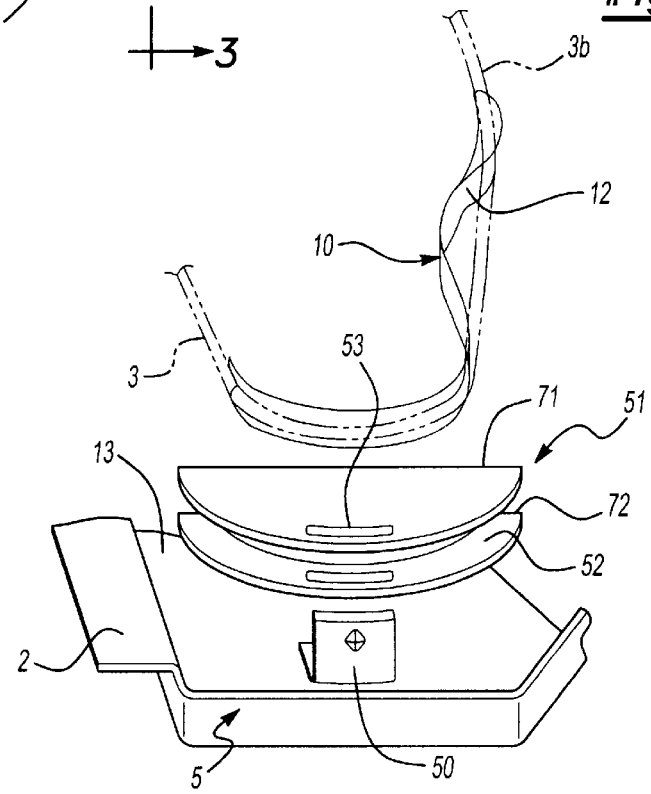
FIG. 4 shows, in a perspective and exploded view, a plate spring arrangement according to a second embodiment of the invention.

FIG. 4 shows one alternative to the first embodiment of the invention. The lower end 13 of rail 2 carries a tab 50 for mounting a semi-circular part 51 which performs the function of spring maintaining means thanks to a peripheral channel 52. The peripheral channel 52 is formed by two flanges 71, 72 extending radially from the semi-circular part. Tab 50 is housed in a slot 53 formed in part 51. The channel 52 is designed to receive the curved end of a plate spring 10 the free end of which has the guiding channel 12 bearing against cable 3.

One could also use a semi-circular part 51 provided with a groove for inserting and maintaining the cylindrical fixed cable between portion 42 of the spring 10. The peripheral channel 42 can be used for guiding the cable in this embodiment.

In the examples above, spring 10 is a plate-type spring.

Figures 5, 6:
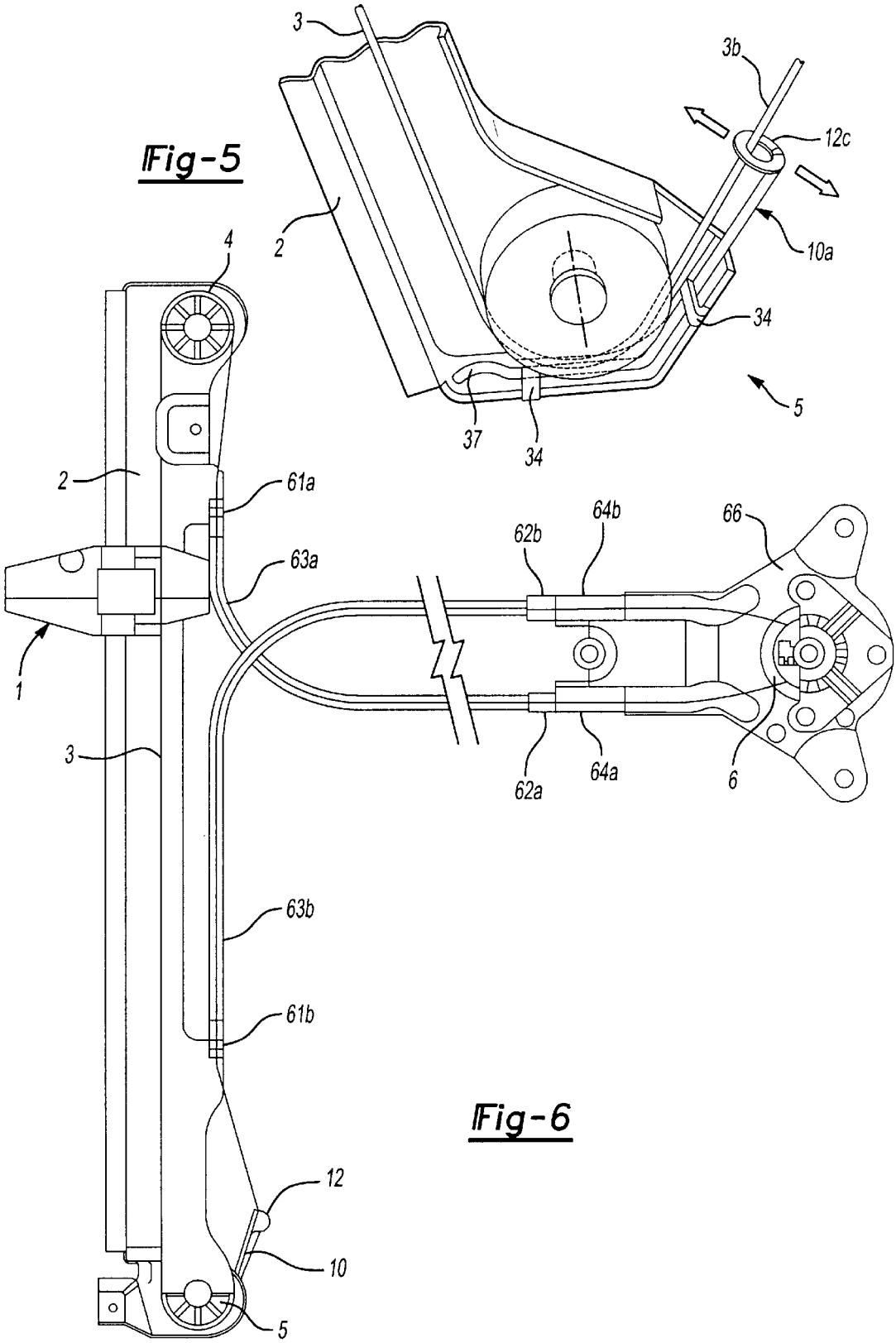
FIG. 5 shows, in a perspective view, a wire spring arrangement according to a third embodiment of the invention.
FIG. 6 shows a single-rail window lifter with sheathed cables, according to the invention.

As shown in FIG. 5, spring 10 can be a wire spring 10*a* in which guiding channel 12 takes the form of an eyelet or loop 12*c* formed at the free end of spring wire 10*a*. The cable passes through the loop 12*c*. In this alternative embodiment, the spring wire 10*a* can exercise an inwardly- or outwardly-directed force on cable 3. The eyelets 12*c* prevents the cable 3 from getting out of the guiding channel 12. One can use a closed loop for preventing the cable 3 from getting out. The wire spring 10*a* can however comprise an aperture for the insertion of the cable. The mounting of the cable 3 in the loop 12*c* is thus faster and easier. By using an aperture slightly wider than the cable width, one can insert the cable 3 easily while preventing in most cases the cable 3 from getting out of the loop 12*c*. The wire spring 10*a* can also provide a curved portion 37 arranged at the bottom of the guide rail 2, and forming a yielding lower abutment for slider 1. The spring can be fixed to the rail 2 with hooks 34 provided at the end of the rail.

Such a cable tensioning arrangement can be embodied in different window lifter arrangements. While the invention was described above with a single slider and a single rail, a window lifter with two sliders or two rails remains within the scope of the invention as recited in the appended claims.

FIG. 6 shows a single-rail window lifter 1 according to a first embodiment of the invention. It provides the following features:

a) the stop members 61*a* and 61*b* provided on guide rail 2 are located away from the return means 4 and 5;

b) the ends 62*a* and 62*b* of cable sheaths 63*a* and 63*b* bear directly against end stops 64*a* and 64*b;* c) spring 10 of the plate spring type is secured to the end of rail 2 close to return means 4 and 5, the spring being shaped so that its free end include a guide channel 12 which slidingly bears against a portion of cable run 4*b* which extends between return means 5 and rail end stops 61*b*.

Figure 7:
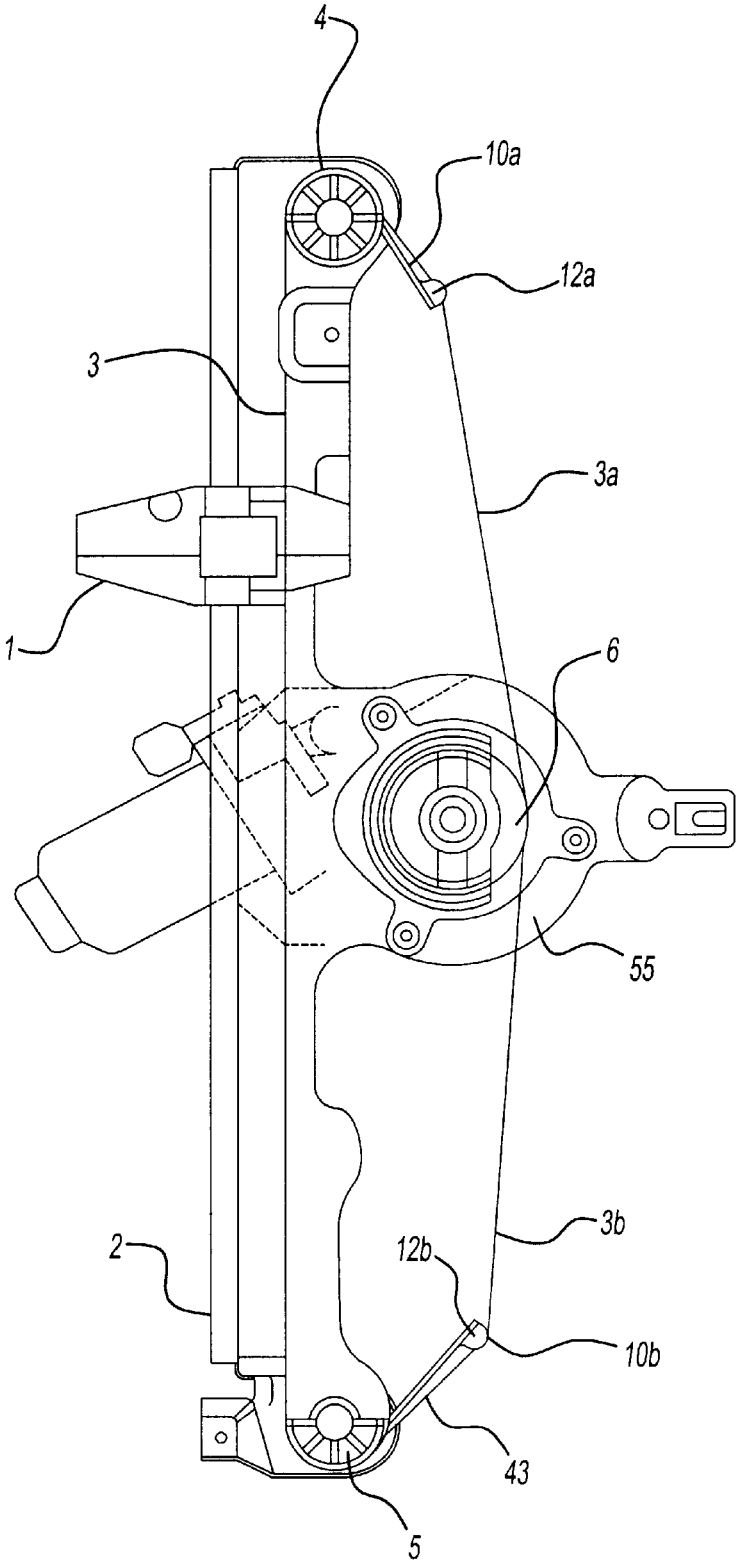
FIG. 7 is an alternative embodiment of the guide rail of the window lifter in FIG. 6.

FIG. 7 shows one alternative embodiment of the first embodiment shown in FIG. 6. Guide rail 2 further includes an arm 55 which extends perpendicular to the general direction of rail 2. Winding drum 6 can be mounted on a plate 66 as illustrated in FIG. 6. However, winding drum 6 can also be mounted on arm 55. In this case, the cable sheaths can be omitted, and cable runs 3*a* and 3*b* extend respectively to their return means 4 and 5 without going via the end stops 61*a* and 61*b* of rail 2. The guide channels 12*a*, 12*b* of plate springs 10*a*, 10*b* bear slidingly against the cable run 3*a*, 3*b*. This arrangement makes it possible to employ the same guide rail 2 for two different assemblies of window lifter, thereby reducing the cost of manufacturing the rails, the number of tools required to produce rail 2 and the number of items held in stock. The window lifter of FIG. 7 comprises two springs 10*a*, 10*b* whereas the window lifter of FIG. 6 comprises one spring. The worker skilled in the art can obviously derive window lifters of this type with one or two springs with the help of the present description.

Figure 8:
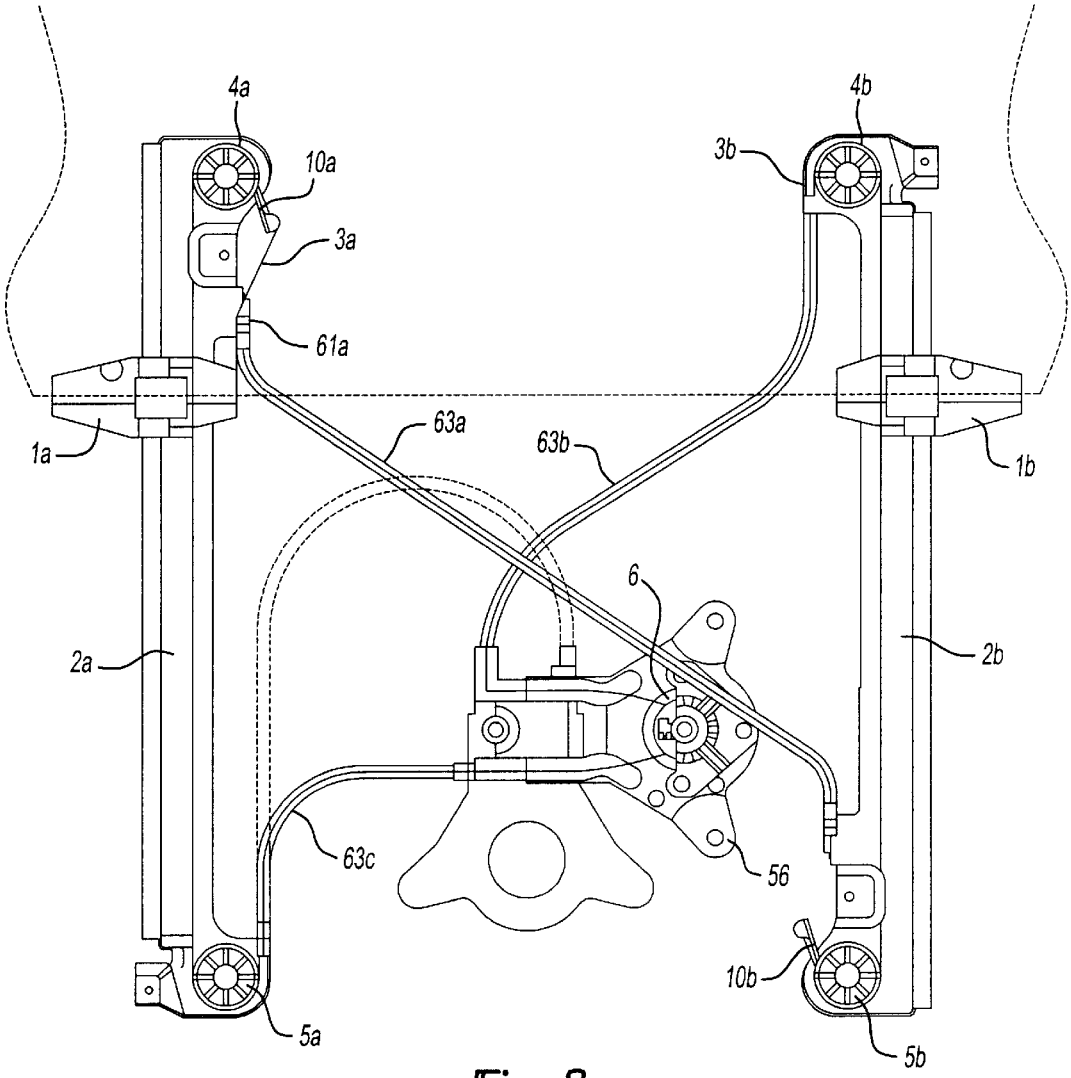
FIG. 8 is a window lifter with two rails, with branches of sheathed cable in an X-configuration between the rails, including tensioning means according to the invention.

FIG. 8 shows a window lifter having two substantially parallel rails 2*a*, 2*b* and similar to the one in FIG. 6, on which sliders 1*a* and 1*b* slide, driven in unison by cable 3, the cable runs 3*a* and 3*b* of which, arranged in an "X" configuration between the ends of rails 2*a* and 2*b* are inserted inside sheaths 63*a*, 63*b* and 63*c*. The cable 3 passes over return means 4*a* and 5*a* on the rail 2*a* and over return means 4*b* and 5*b* on rail 2*b*. Winding drum 6 is mounted on plate 66 in the arm of the "X" linking the lower return means 5*a* of the rail 2*a* to upper return means 4*b* of rail 2*b*.

Sheath 63*a* which defines the other arm of the "X" extends integrally between an upper end stop 61*a* of rail 2*a* and a lower end stop 10*b* of rail 2*b*. Cable run 3*a* partially inserted in sheath 63*a* links upper return means 4*a* of rail 2*a* to lower return means 5*b* of rail 2*b*. This cable run 3*a* is tensioned by means of the plate springs 10*a,* 10*b* one of which, 10*a,* is provided at the upper end of rail 2*a* and the other of which, 10*b,* is provided at the lower end of rail 2*b*.

Obviously, plate springs can just as well be mounted at the lower end of the rail 2*a* and at the upper end of rail 2*b*.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A window lifter comprising:

a window slider;

a cable driving said window slider;

a cable return system; and a spring including a mobile cable tensioning portion engaging the cable, and a fixed cable return portion engaging the cable and positioned between the cable and the cable return system where at a location of engagement of the fixed cable return portion and cable return system the fixed cable return portion of the spring wraps around the cable return system.

2. The window lifter of claim 1, wherein the cable return system is provided on a support plate.

3. The window lifter according to claim 2, wherein the fixed cable return portion is attached to the cable return system.

4. The window lifter of claim 1, wherein the mobile cable tensioning portion of said spring has a cable guiding channel portion.

5. The window lifter of claim 1, wherein the fixed cable return portion has a cable guiding channel.

6. The window lifter of claim 1, wherein the spring is a plate spring.

7. The window lifter of claim 1, further comprising a supporting plate having cable sheath stops, a drum mounted rotatably on the supporting plate driving the cable, a slider guiding rail separated front the supporting plate and having two cable return systems and cable sheath stops, and cable sheaths surrounding the cable between respective rail cable sheath stops and supporting plate cable sheath stops.

8. The window lifter of claim 1, further comprising a slider guiding rail having two cable return systems, a protruding plate, and a drum mounted rotatably on the protruding plate and driving the cable.

9. The window lifter of claim 1, wherein the fixed cable return portion includes a channel which receives the cable.

10. The window lifter of claim 9, wherein the channel is v-shaped.

11. A window lifter comprising:

a window slider;

a cable driving said window slider;

a cable return system provided on a support plate, and a tab is fixed to the support plate; and a spring including a mobile cable tensioning portion engaging the cable and a fixed cable return portion engaging the cable and positioned between the cable and the cable return system, and wherein said cable return system includes two flanges on opposing sides of the spring having respective aligned slots through which the tab extends.

12. A window lifter comprising:

a window slider;

a cable driving said window slider;

a spring including a mobile cable tensioning portion engaging the cable and a fixed cable return portion engaging the cable; and a supporting plate including two cable sheath stops, two sliding guiding rails separated from the supporting plate each having two cable return systems and two cable sheath stops; and three cable sheaths surrounding the cable respectively between a first rail cable sheath stop and a first supporting plate cable sheath stop, between a second rail cable sheath stop and a second supporting plate cable sheath stop and between remaining cable sheath stops of the first and second rail.

13. A window lifter comprising:

a window slider;

a cable driving said window slider; and a wire spring having a fixed portion and a mobile cable tensioning portion having a loop through which the cable passes.

14. The window lifter of claim 13, wherein the wire spring is located at the side of a cable return system and the spring fixed portion has a curved end that engages resiliently with the slider.

15. The window lifter of claim 13, wherein said loop has an aperture adapted for inserting the cable in the loop.

16. The window lifter of claim 13, further comprising a supporting plate having cable sheath stops, a drum mounted rotatably on the supporting plate, driving the cable, a slider guiding rail having two cable return systems, separated from the supporting plate, and having cable sheath stops, and cable sheaths surrounding the cable between respective rail cable sheath stops and supporting plate cable sheath stops.

17. The window lifter of claim 13, further comprising slider guiding rail having two cable return systems at an ends and having a protruding plate, and a drum mounted rotatably on the protruding plate and driving the cable.

18. The window lifter of claim 13, further comprising a supporting plate having two cable sheath stops, two sliding guiding rails separated from the supporting plate, having respectively two cable return systems and two cable sheath stops, and three cable sheaths surrounding the cable respectively between a first rail cable sheath stop and a first supporting plate cable sheath stop, between a second rail cable sheath stop and a second supporting plate cable sheath stop and between remaining cable sheath stops of the first and second rail.

19. A window lifter comprising:

a window slider;

a cable driving said window slider;

a cable return system; and a spring including a mobile cable tensioning portion engaging the cable and a fixed cable return portion engaging the cable and positioned between the cable and the cable return system, and wherein the cable return system includes a plurality of hooks which engage a plurality of notches on the fixed cable return portion of the spring.

20. The window lifter of claim 19, wherein there are three of the hooks on the cable return system and three of the notches on the fixed cable return portion.

* * * * *